US005139859A

United States Patent [19]

Karvanen

[11] Patent Number: 5,139,859

[45] Date of Patent: Aug. 18, 1992

[54] WOVEN MAT FOR HUMID SPACES

[76] Inventor: Salme Karvanen, Mikontie 4 D, Riihimäki, Finland, SF-11910

[21] Appl. No.: 239,282

[22] Filed: Sep. 1, 1988

[30] Foreign Application Priority Data

Sep. 2, 1987 [FI] Finland ..... 873810

[51] Int. Cl.[5] ..... D03D 3/00

[52] U.S. Cl. ..... 428/229; 139/387 R; 139/421; 139/422; 139/423; 428/193; 428/231; 428/257; 428/258; 428/259

[58] Field of Search ..... 428/193, 222, 231, 257, 428/258, 259, 229; 139/421, 422, 423, 387 R

[56] References Cited

U.S. PATENT DOCUMENTS

| | | | |
|---|---|---|---|
| 2,518,110 | 8/1950 | Ahlers | 139/421 |
| 2,643,686 | 6/1953 | Richards | 139/421 |
| 3,622,431 | 11/1971 | Turcksin | 428/231 |
| 4,510,975 | 4/1985 | Ojanpern | 428/193 |
| 4,816,028 | 3/1989 | Hapadia et al. | 428/257 |
| 5,023,132 | 6/1991 | Stanley et al. | 428/234 |

*Primary Examiner*—James J. Bell

*Attorney, Agent, or Firm*—Fleit, Jacobson, Cohn, Price, Holman & Stern

[57] ABSTRACT

The invention relates to a woven mat for humid spaces. The warp system comprises textile yarns (3*a*, 3*b*), which are preferably of a water-repellent synthetic material, and the weft system comprises at least an elastic, water-impermeable circular ribbon (1), such as a plastic or rubber circular ribbon. Thus water absorption is prevented in the mat, which does not feel wet. The mat is agreeable to stand on, owing to the elastic circular ribbon wefts, and the mat has an easy maintenance and dries rapidly. In addition to the circular ribbon wefts, the mat can comprise textile wefts, for example a ribbon and a textile yarn alternating in every second weft.

The borders of the mat in the direction of the weft are bordered with a cleaved plastic hose (4), which is fixed by a listing seam (5) and on the borders in the direction of the warp simply a listing seam (5) is provided.

13 Claims, 1 Drawing Sheet

WOVEN MAT FOR HUMID SPACES

Figure 1:
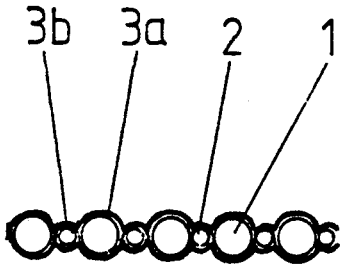

This invention relates to woven mats for humid spaces, in which the weft and warp systems are formed by an elastic rubber or plastic ribbon and a textile yarn.

Nowadays mats woven of various materials are used in the washing rooms of hotels, saunas and the like, and in other damp spaces, such as hallways. Cotton rugs are used, which are agreeable to the feet when being dry, but have a high water-content when being wet, and dry very slowly. Mats woven of plastic strips are used, which have a hard surface and dry rapidly in fact, but do not absorb water, being permeable to water, which gives an impression of standing in a water pool. Most commonly used today are probably mats woven of synthetic yarn, which are agreeable to the feet, but are water-permeable like plastic mats, due to lacking water absorption.

The object of this invention is to reduce the drawbacks of known mats and to provide a mat that is hygienic and agreeable to the feet, even massaging, warm and elastic, and is impermeable to water, only gets damp and dries rapidly.

Such a mat has been achieved by means of the characteristics defined in claim 1.

In the warp of the mat a textile yarn is used, which preferably is synthetic and water-repellent. In the weft an elastic waterimpermeable ribbon, larger than usual textile yarn, material is used, such as a rubber or plastic circular ribbon or a silicone hose. Preferably a compact plastic hose is used, because it does not get wet nor absorb moisture or dirt, and thus is very hygienic. Such as circular plastic ribbon or hose is preferably of PVC. In addition to the plastic circular ribbon weft, a textile yarn can also be used as an intermediate weft.

Considering the product, it does naturally not make any difference whether the warp consists of a textile yarn or a plastic circular ribbon and the weft correspondingly of a textile yarn, but with regard to the production, the use of a textile yarn in the warp is more economical.

Such a mat gets damp only on the surface and not throughout its thickness. Thus it does never feel wet. Owing to the flutes generated by the thickness of the plastic circular ribbon, the water is allowed to flow from underneath the mat and thus does not give any pool impression.

Both acrylic yarn and propylene yarn are appropriate as a waterrepellent and rapidly drying warp yarn. They are also usable as an intermediate warp yarn.

The mat is manufactured on a conventional rug loom. Preferably the circular ribbon or hose weft is introduced in the shed in lengths corresponding to the width of the mat sections. The selvage of the mat is preferably formed by listing with a listing machine. The transverse borders of the mat are preferably finished with cleaved plastic hoses, which are slipped onto the border of the mat. The listing can also be carried out with a U-shaped PVC ribbon also on a mat listing machine.

A common warp rib binding is preferably used as a binding, a plastic circular ribbon being used in the weft. Owing to the thickness of the weft, this binding produces a rib effect. The warp is made dense enough for the circular weft ribbon used in the weft to be entirely covered.

By alternating for instance a plastic circular ribbon and a thinner textile yarn in every second weft, and by using a two-coloured warp yarn, nice stripe effects can be produced.

The plastic circular ribbon has preferably a ca. 5 mm crosssection and the textile yarn a Nm 10/4 thickness. The thickness can also be e.g. Nm 5/3 with a dense twist in order to provide a good strength and crockfastness. With these combinations the desired properties of the mat are provided. The thickness ratios may of course vary.

The excellent properties of the mat according to the invention as used in humid spaces are due to the hose wefts comprised in it, which are not water-permeable nor water-absorbing and which raise the upper surface of the mat over 5 mm from the floor surface. Since a water-repellent yarn has been used as a textile yarn, the mat dries rapidly after having become damp. The mat is easily washed and centrifugated in a washing-machine. The mat is agreeable to stand on, feeling soft by means of the elastic or resilient round wefts. The mat does not smell even when being damp, as do mats made of natural fibre materials.

As shown above, the mat is easy to manufacture on a conventional rug loom. The production costs can be reduced by automizing the introduction of the plastic circular ribbon weft into the shed. Nice checkers and colour surfaces are easily produced on the mat.

Figure 2:
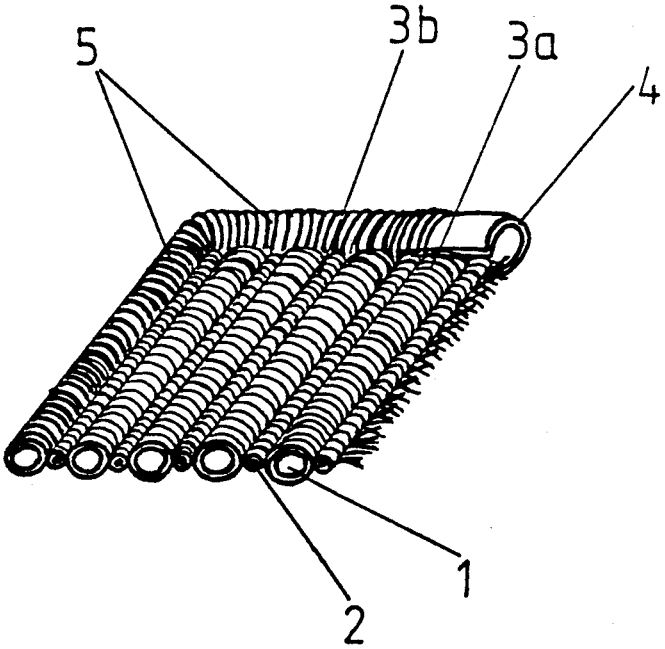

The structure of the mat according to the invention is described in detail below as a preferred embodiment example and referring to the enclosed figures, in which:

FIG. 1 presents a section of the mat structure in the direction of the warp and FIG. 2 presents a perspective projection of a corner of the finished mat.

In the figures, the circular ribbon weft is marked with number 1, the textile yarn weft with number 2, the warp yarn with numbers 3*a* and 3*b*, the edging cleaved circular ribbon or hose with number 4 and the border listing with number 5.

The binding is a warp rib binding. In the case of the example, nice stripes in the direction of the weft have been achieved by alternating two warp yarns 3*a* and 3*b* of different colours, and by alternating a thick plastic circular ribbon and a thin textile yarn in the weft, whereby the thin stripes in the direction of the weft get one colour and the large stripes in the direction of the weft get another colour. By alternating warp yarns of different colours, i.e. by using two warp yarns of the colour 3*a* and two warp yarns of the colour 3*b* next to each other in the warp, the main colour, i.e. the colour of the thick wefts, becomes opposite, and longitudinal stripes are achieved in the mat.

Stripes in the direction of the warp are also simply produced by using warp yarns of different colours for the different stripes, whereby the stripes become single-coloured inside the stripes.

I claim:

1. A woven mat for moist spaces, in which the weft and warp systems are formed by a resilient hose and a textile yarn, characterized in that one of the yarn systems comprises at least a water-impermeable circular, large diameter resilient hose (1), and in that the other yarn system comprises a waterrepellent smaller diameter textile yarn, and in that the binding is a warp rib binding.

2. A mat according to claim 1, characterized in that said one yarn system comprises the weft system.

3. A mat according to claim 1, characterized in that the said circular hose and a textile yarn are alternated in the weft.

4. A mat according to claim 1, characterized in that the circular hose is hollow.

5. A mat according to claim 1, characterized in that the weft comprises a compact PVC circular hose.

6. A mat according to claim 1, characterized in that the warp yarn (3*a*, 3*b*) is an acrylic yarn.

7. A mat according to claim 1, characterized in that the selvages of the mat are listed with a cleaved plastic hose (4) which is fixed by a listing seam.

8. A mat according to claim 1, characterized in that the selvages of the mat are listed.

9. A mat according to claim 1, characterized in that said one yarn system comprises the warp system.

10. A mat according to claim 1, characterized in that the circular hose is compact.

11. A mat according to claim 1, characterized in that the weft comprises a rubber hose.

12. A mat according to claim 1, characterized in that the weft comprises a silicone hose.

13. A mat according to claim 1, characterized in that the warp yarn comprises polypropylene yarn.

* * * * *